US009773384B2

(12) United States Patent
Nauman

(10) Patent No.: US 9,773,384 B2
(45) Date of Patent: Sep. 26, 2017

(54) WAGERING GAME WITH GRAPHICAL RECONFIGURATION OF OVERSIZED SYMBOL DETERMINED BY REST LOCATION

(71) Applicant: WMS Gaming Inc., Waukegan, IL (US)

(72) Inventor: Jeffry L. Nauman, Yorkville, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 571 days.

(21) Appl. No.: 14/322,474

(22) Filed: Jul. 2, 2014

(65) Prior Publication Data

US 2015/0011291 A1 Jan. 8, 2015

Related U.S. Application Data

(60) Provisional application No. 61/842,696, filed on Jul. 3, 2013.

(51) Int. Cl.
*A63F 9/24* (2006.01)
*G07F 17/34* (2006.01)

(52) U.S. Cl.
CPC ..... *G07F 17/34* (2013.01)

(58) Field of Classification Search
CPC ..... G07F 17/32; G07F 17/3211
USPC ..... 463/6–20, 30–33
See application file for complete search history.

(56) References Cited

U.S. PATENT DOCUMENTS

| | | | | |
|---|---|---|---|---|
| 6,517,433 | B2 | 2/2003 | Loose et al. | |
| 7,410,420 | B2 * | 8/2008 | Shiraishi | G07F 17/3211 463/16 |
| 8,382,570 | B2 | 2/2013 | Bennett | |
| 2002/0047238 | A1 | 4/2002 | Ainsworth et al. | |
| 2008/0108411 | A1 | 5/2008 | Jensen et al. | |
| 2008/0139294 | A1 * | 6/2008 | Inamura | G07F 17/32 463/20 |
| 2008/0242404 | A1 | 10/2008 | Aoki | |
| 2009/0061984 | A1 | 3/2009 | Yi | |
| 2009/0117983 | A1 | 5/2009 | Visser | |

(Continued)

OTHER PUBLICATIONS

U.S. Appl. No. 13/835,026, titled "Wagering Games Employing A Mega Symbol," filed Mar. 15, 2013, Inventors: Jeremy Hornik, et al.

*Primary Examiner* — Omkar Deodhar
*Assistant Examiner* — Ross Williams
(74) *Attorney, Agent, or Firm* — David J. Bremer

(57) ABSTRACT

A method in a gaming system includes receiving a wager and displaying an array having a plurality of array positions. The array positions are populated by symbols located on symbol-bearing reels, including an oversized symbol occupying a plurality of reel-symbol positions on one of the reels and having an image extending over those reel-symbol positions. The method also includes determining whether the oversized symbol will be only partially displayed in the array based on a rest location determined for the oversized symbol. If the oversized symbol will be only partially displayed in the array, the image of the oversized symbol is graphically reconfigured. The method includes spinning and stopping the reels to place the symbols in the determined rest locations. The first portion of the oversized symbol is displayed in the array with the graphically reconfigured image. The method also includes awarding a payout.

20 Claims, 14 Drawing Sheets

(56) References Cited

U.S. PATENT DOCUMENTS

| | | | |
|---|---|---|---|
| 2009/0227338 | A1 | 9/2009 | Yoshizawa |
| 2009/0286588 | A1 | 11/2009 | Jackson |
| 2010/0069160 | A1 | 3/2010 | Barrett et al. |
| 2010/0234099 | A1 | 9/2010 | Rasmussen et al. |
| 2011/0117987 | A1 | 5/2011 | Aoki et al. |
| 2011/0117993 | A1 | 5/2011 | Carlson et al. |
| 2012/0157181 | A1 | 6/2012 | Jensen et al. |
| 2012/0190438 | A1 | 7/2012 | Bartosik et al. |
| 2013/0324213 | A1 | 12/2013 | Aoki et al. |

* cited by examiner

WAGERING GAME WITH GRAPHICAL RECONFIGURATION OF OVERSIZED SYMBOL DETERMINED BY REST LOCATION

CROSS-REFERENCE TO RELATED APPLICATIONS

This application is related to and claims priority to U.S. Provisional Patent Application Ser. No. 61/842,696, filed Jul. 3, 2013, and titled "Wagering Game With Graphical Reconfiguration Of Oversized Symbols Determined By Rest Location," which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatuses and methods and, more particularly, to gaming apparatuses and methods for a wagering game employing a graphical reconfiguration of an oversized symbol.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system comprises one or more input devices, one or more display devices, one or more processors, and one or more memory devices storing instructions that, when executed by the one or more processors, cause the gaming system to receive, via at least one of the one or more input devices, an input indicative of a wager. The instructions further cause the gaming system to display on the at least one display device an array having a plurality of array positions. Each of the plurality of array positions is populated by at least one of a plurality of symbols located on a plurality of symbol-bearing reels. The plurality of symbols include an oversized symbol. The oversized symbol occupies a plurality of reel-symbol positions on a first one of the plurality of symbol-bearing reels. The oversized symbol has an image extending over the plurality of reel-symbol positions occupied by the oversized symbol. The instructions also cause the gaming system to determine a rest location of the plurality of symbols for a play of a wagering game and determine whether the oversized symbol will be only partially displayed in the array based on the rest location of the oversized symbol. The plurality of reel-symbol positions occupied by the oversized symbol include a first portion that will be displayed in the array and a second portion that will not be displayed in the array. In response to the determination that the oversized symbol will be only partially displayed in the array, the instructions cause the gaming system to graphically reconfigure the image of the oversized symbol such that at least one of a different size of the image or a different portion of the image extends over the first portion of the plurality of reel-symbol positions occupied by the oversized symbol, spin and stop the plurality of symbol-bearing reels to place the plurality of symbols on the symbol-bearing reels in the determined rest locations with respect to the array, and award a payout based on the symbols displayed in the array. The first portion of the oversized symbol is displayed in the array with the graphically reconfigured image.

According to another aspect of the invention, a computer-implemented method in a gaming system comprises receiving, via one or more input devices, an input indicative of a wager, and displaying on at least one display device an array having a plurality of array positions. Each of the plurality of array positions is populated by at least one of a plurality of symbols located on a plurality symbol-bearing reels. The plurality of symbols include an oversized symbol. The oversized symbol occupies a plurality of reel-symbol positions on a first one of the plurality of symbol-bearing reels. The oversized symbol has an image extending over the plurality of reel-symbol positions occupied by the oversized symbol. The method further comprises determining a rest location of the plurality of symbols for a play of a wagering game, and determining whether the oversized symbol will be only partially displayed in the array based on the rest location of the oversized symbol. The plurality of reel-symbol positions occupied by the oversized symbol includes a first portion that will be displayed in the array and a second portion that will not be displayed in the array. In response to the determination that the oversized symbol will be only partially displayed in the array, the method includes graphically reconfiguring the image of the oversized symbol such that at least one of a different size of the image or a different portion of the image extends over the first portion of the plurality of reel-symbol positions occupied by the oversized symbol. The method further comprises spinning and stopping the plurality of symbol-bearing reels to place the plurality of symbols on the symbol-bearing reels in the determined rest locations with respect to the array. The first portion of the oversized symbol is displayed in the array with the graphically reconfigured image. The method also includes awarding a payout based on the symbols displayed in the array.

According to yet another aspect of the invention, computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1:
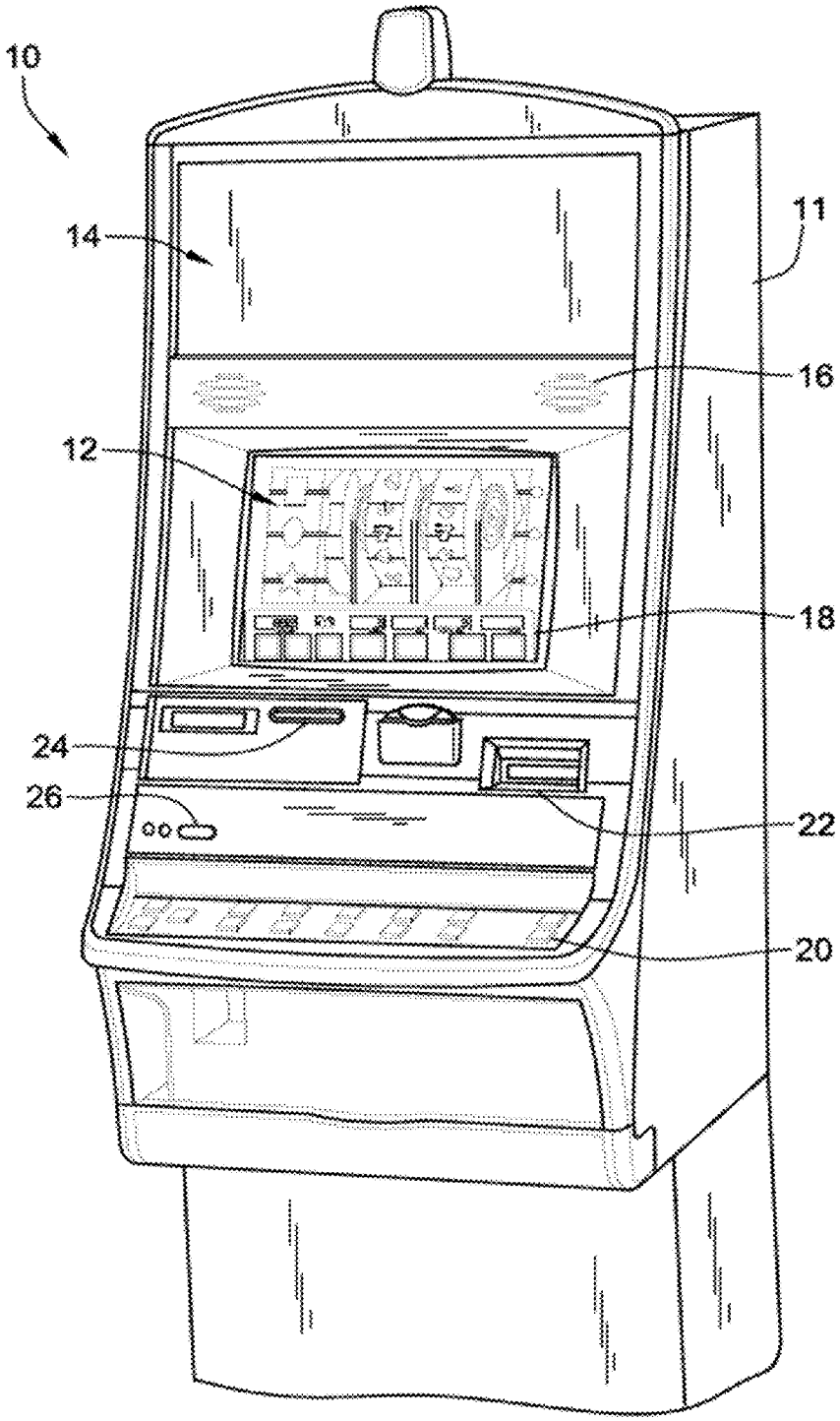
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
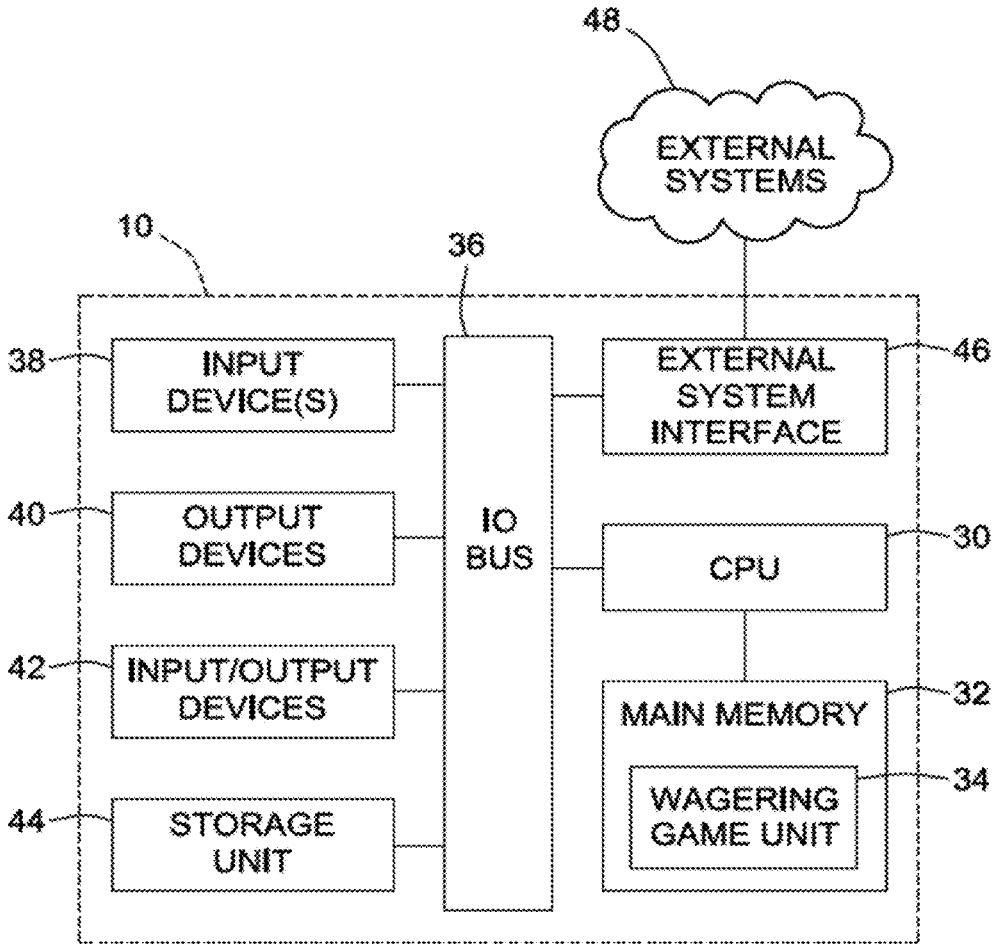
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
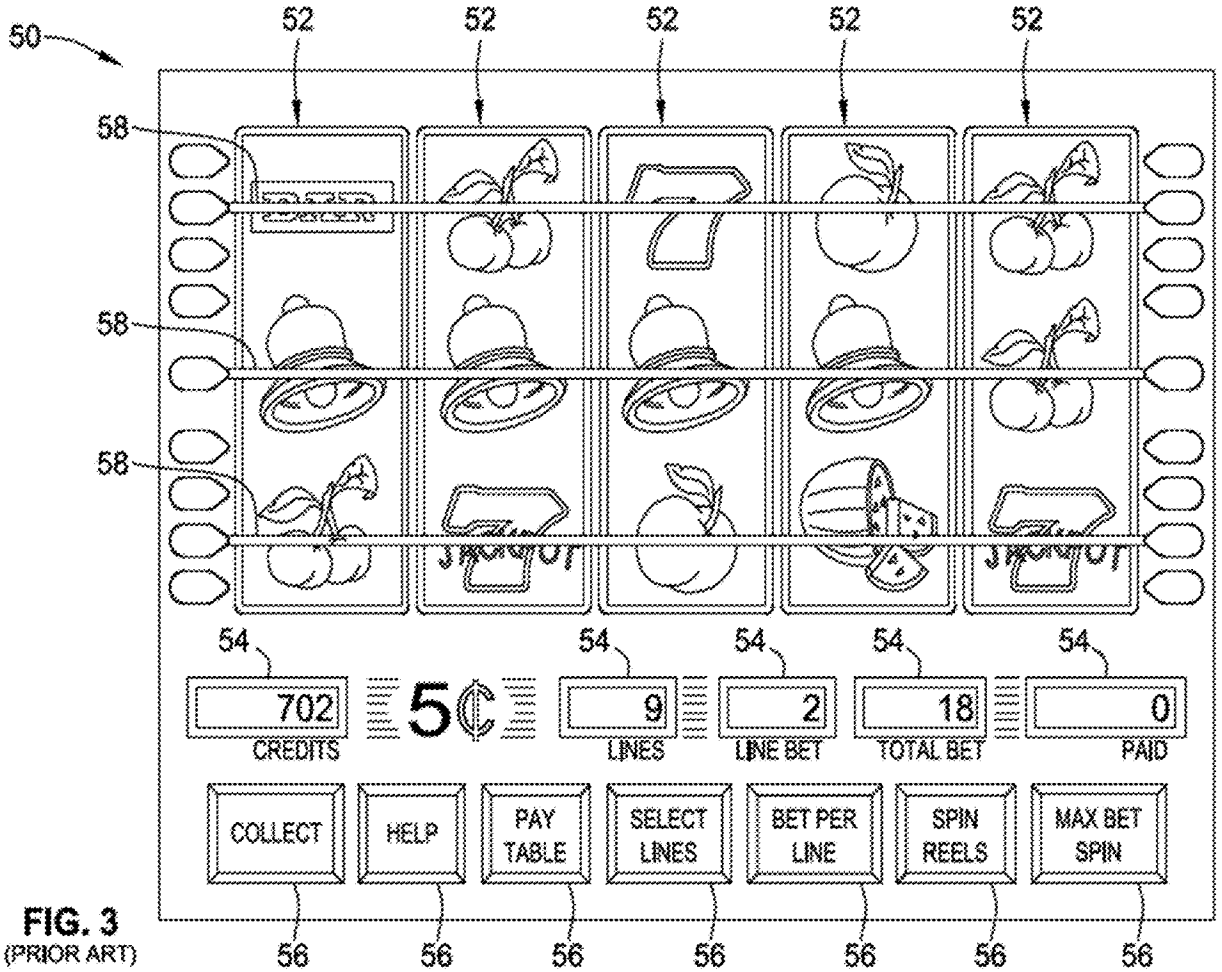
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
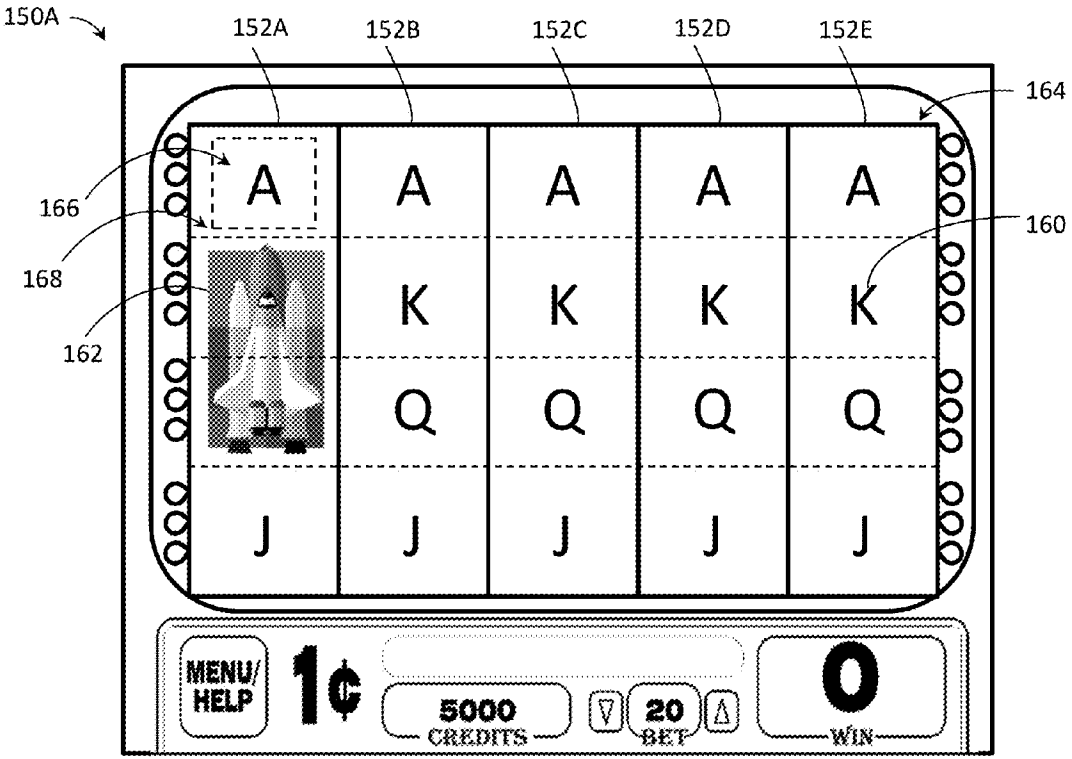
FIG. 4 is an image of an exemplary game screen of a wagering game displayed on a gaming terminal, according to an embodiment of the present invention.

Referring now to FIGS. 4-15B, embodiments of a wagering game employing a graphical reconfiguration of an oversized symbol 162 will be described. FIG. 4 illustrates an image of an exemplary game screen 150A adapted to be displayed on a display area of the primary display 12 or the secondary display 14. The game screen 150A portrays a plurality of symbol-bearing reels 152A-152E having a plurality of symbols 160 (i.e., the "A", "K", "Q", and "J" symbols illustrated in FIG. 4) and an oversized symbol 162 (i.e., the "spaceship" symbol illustrated in FIG. 4). The reels 152A-152E include a leftmost first reel 152A, which is adjacent to a second reel 152B. The second reel 152B is adjacent to a central third reel 152C, which is adjacent to a fourth reel 152D. The fourth reel 152D is adjacent to a rightmost reel 152E. The portions of the plurality of symbol-bearing reels 152A-152E displayed (e.g., in the primary display area 12 and/or the secondary display area 14) form a five-by-four array 164 (e.g., five reels 152A-152E, each four reel-symbol positions 166 high). Accordingly, as illustrated, the five-by-four array 164 includes twenty unique, individual array positions 168 (i.e., five array columns, each four array positions 168 high). It should be understood that the array 164 can have a size other than five-by-four such as, for example, a five-by-three array, a six-by-ten array, an eight-by-twenty array, etc.

Figure 5:
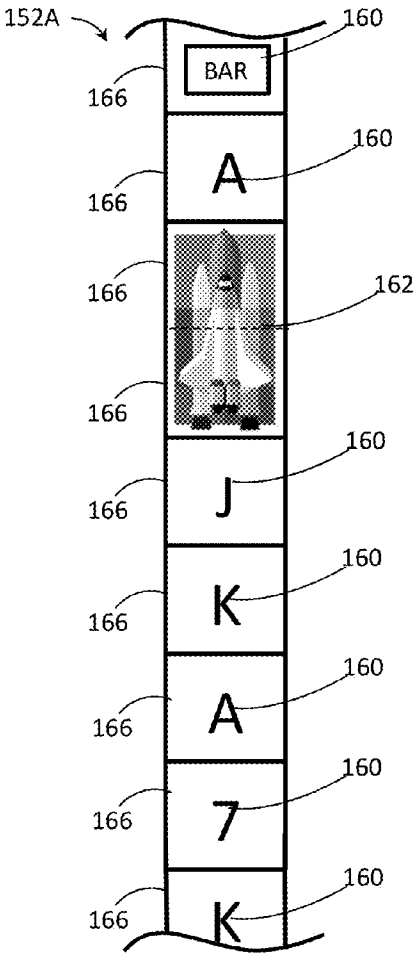
FIG. 5 is an image of an exemplary portion of a symbol-bearing reel, according to an embodiment of the present invention.

The plurality of symbols 160 are symbols respectively associated with dedicated reel-symbol positions 166 of respective reels 152A-152E. For example, FIG. 5 illustrates an exemplary portion of the first reel 152A with the symbols 160 thereon each occupying a respective reel-symbol position 166 on the first reel 152A. Upon the reels 152A-152E coming to rest after a spin of a wagering game, each of the plurality of symbols 160 displayed within the array 164 occupies a single array position 168 within the array 164 (as shown in FIG. 4). The symbols 160 in the reel-symbol positions 166 that are not in visual association with the array 164 are not displayed.

In contrast to the symbols 160, which each occupy a single reel-symbol position 166, the oversized symbol 162 is a symbol that occupies multiple reel-symbol positions 166 on a single reel 152A-152E and has an associated image (e.g., a spaceship image in FIGS. 4-5) that extends over all reel-symbol positions 166 occupied by the oversized symbol 162. For example, in FIG. 5, the oversized symbol 162 occupies two reel-symbol positions 166 on the first reel 152A. Accordingly, FIG. 4 illustrates an outcome for a play of the wagering game in which the entire oversized symbol 162 is displayed within the array 164. That is, in FIG. 4, all reel-symbol positions 166 occupied by the oversized symbol 162 are in visual association with array positions 168 of the array 164. As shown in FIG. 4, the oversized symbol 162 occupies multiple array positions 168 on one of the array columns when the oversized symbol 162 is displayed entirely within the array 164 (i.e., the oversized symbol 162 has a minimum size of one-by-two array positions 168 when displayed entirely within the array 164). However, it should be understood that the oversized symbol 162 can have other sizes (e.g., a size as small as two reel-symbol positions 166 and as large as the maximum number of reel-symbol positions 166 that can be displayed at one time in a column of the array 164). Additionally, while the oversized symbol 162 is located on the first reel 152A in FIG. 4, the oversized symbol 162 can be located on any other reel 152B-152E.

Figures 6A, 6B:
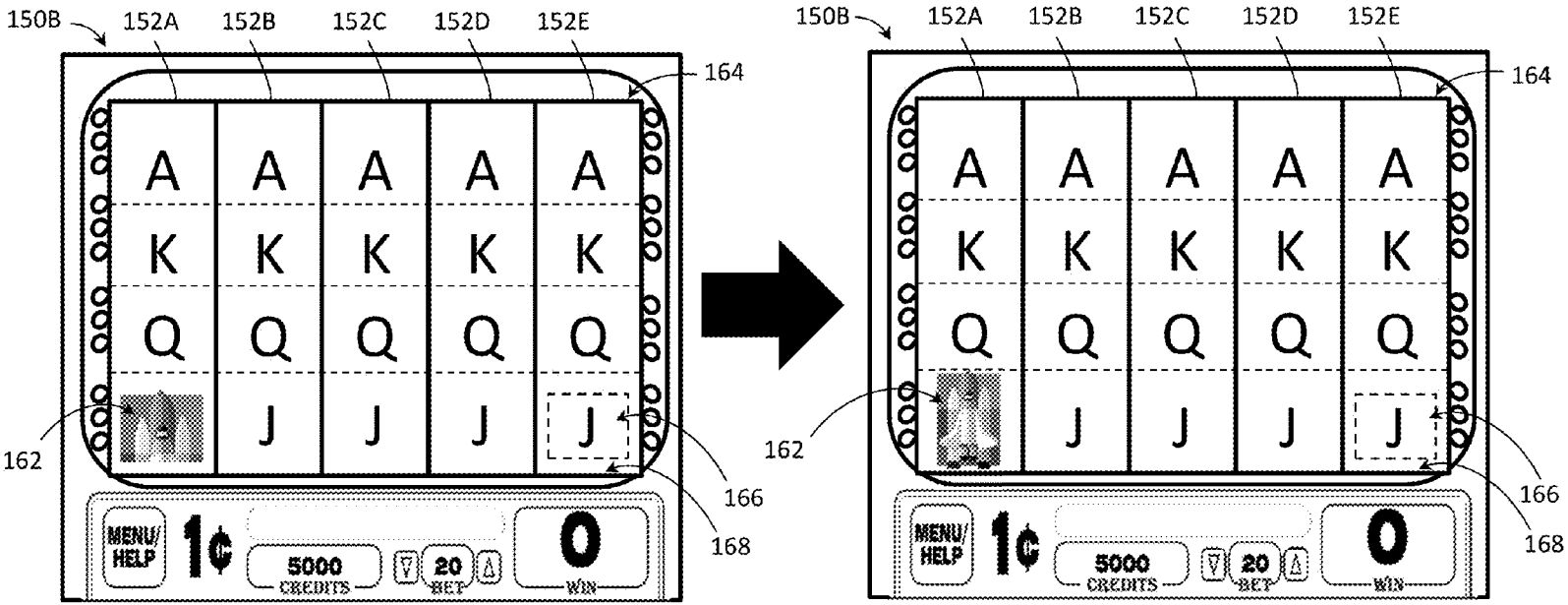
FIGS. 6A-6B are images of an exemplary game screen of a wagering game displayed on a gaming terminal, according to an embodiment of the present invention.

Because the oversized symbol 162 has an associated image that extends over all reel-symbol positions 166 occupied by the oversized symbol 162, a problem is presented when a portion of the oversized symbol 162 is displayed within the array 164 and a portion of the oversized symbol 162 is not displayed within the array 164. For example, FIGS. 6A-6B illustrate an exemplary game screen 150B for an outcome of a wagering game in which the oversized symbol 162 is only partially displayed within the array 164. In FIG. 6A, the image of the oversized symbol 162 is cutoff, making the oversized symbol 162 appear confusing or incomplete to the player. Indeed, it can be difficult for a player to ascertain the type of symbol displayed in the array 164 when only a portion of the image for the oversized symbol 162 is displayed therein.

Advantageously, such problems are mitigated according to aspects of the present disclosure by graphically reconfiguring the image for the oversized symbol 162 based on the rest location of the oversized symbol 162 with respect to the array 164. The graphical reconfiguration of the image can include resizing the image to fit the array positions 168 in which the oversized symbol 162 is displayed. That is, a size of the image can be selected from a plurality of potential sizes based on the number of array positions 168 in which the oversized symbol 162 is displayed, which can be determined from the rest location of the oversized symbol 162.

FIG. 6B illustrates the game screen 150B after the image for the oversized symbol 162 has been graphically reconfigured based on the rest location of the oversized symbol 162. As shown in FIG. 6B, the image of the oversized symbol 162 is resized to fit the array positions 168 occupied by the displayed portion of the oversized symbol 162 (i.e., the entire image for the oversized symbol 162 extends over the array positions 168 for the displayed portion of the oversized symbol 162 within the array 164). Because the entire image of the oversized symbol 162 extends over the array positions 168 occupied by the oversized symbol 162 after the graphical reconfiguration, the player can more clearly perceive that the oversized symbol 162 is located in those array positions 168.

Figure 7:
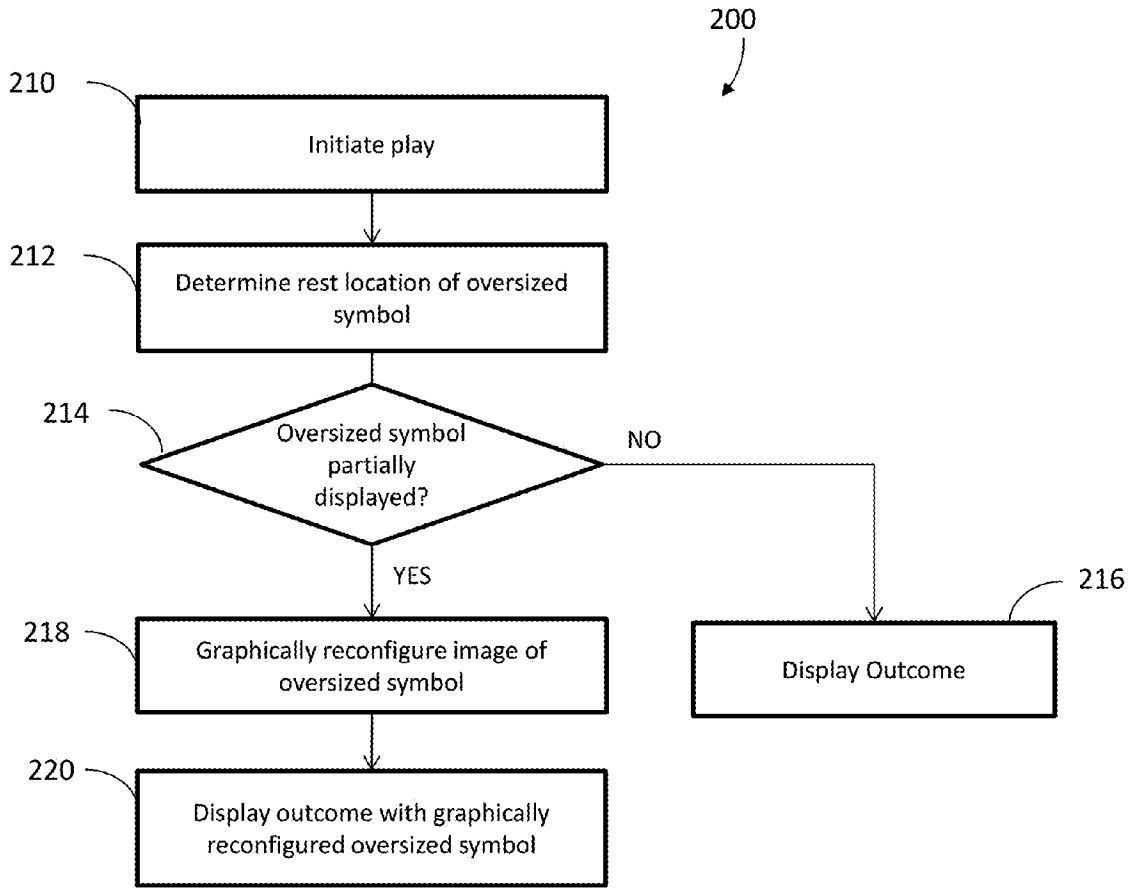
FIG. 7 is a flowchart of an exemplary method for graphically reconfiguring the image of the oversized symbol, according to an embodiment of the present invention.

Referring now to FIG. 7, an exemplary flowchart of a process 200 for graphically reconfiguring the image of the oversized symbol 162 is illustrated. At block 210, a play of the wagering game is initiated. For example, a play may be initiated in response to an input indicative of a wager (e.g., via an input device such as the touch screen 18 or the buttons 20 shown in FIG. 2). At block 212, an outcome for the play of the wagering game is determined by determining the rest location of the reel-symbol positions 166 of the reels 152A-152E (and, thus, the symbols 160 and the oversized symbol 162) with respect the array positions 168 of the array 164 for the play of the wagering game.

At block 214, it is determined whether only a portion of the oversized symbol 162 will be displayed (i.e., partially displayed) in the array 164 based on the rest location of the oversized symbol 162 determined at block 212. For example, if the rest location of the oversized symbol 162 with respect to the array 164 is such that at least one but not all of the reel-symbol positions 166 occupied by the oversized symbol 162 is in visual association with the array 164, then the oversized symbol 162 will be partially displayed within the array 164. If the oversized symbol 162 will not be partially displayed within the array 164, the outcome of the wagering game play is displayed at block 216.

On the other hand, if it is determined at block 214 that the oversized symbol 162 will be only partially displayed in the array 164 for the outcome, the image associated with the oversized symbol 162 is graphically reconfigured at block 218. For example, a size of the image associated with the oversized symbol 162 can be determined based on the rest location of the oversized symbol 162 such that the entire image extends over the reel-symbol positions 166 of the oversized symbol 162 that are in visual association with the array 164. Then, at block 220, the reels 152A-152E are spun and stopped to display the reels 152A-152E in the determined rest locations with respect to the array 164, thereby indicating the outcome of the wagering game play.

According to some aspects of the present disclosure, the oversized symbol 162 is displayed with the graphically reconfigured image determined at block 218 only after the spinning of the reels 152A-152E are stopped at block 220. According to other aspects of the present disclosure, both during the spinning of the reels 152A-152E and after the reels 152A-152E are stopped at block 220, the oversized symbol 162 is displayed with the graphically reconfigured image determined at block 218. In some instances, the reel-symbol positions 166 occupied by the oversized symbol 162 that are determined to have a rest location that is not in visual association with the array 164 can be omitted from the display during the spinning and stop of the reels 152A-152E.

Figure 8C:
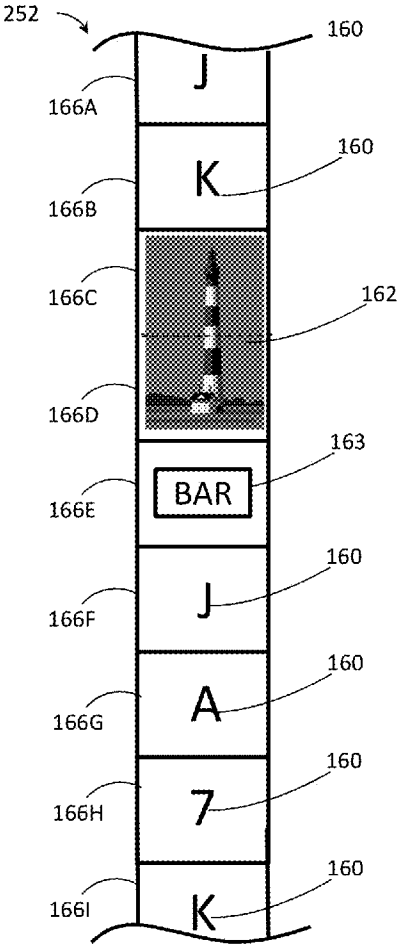
FIGS. 8A-8C are images of exemplary portions of a symbol-bearing reel, according to embodiments of the present invention.
Figure 8B:
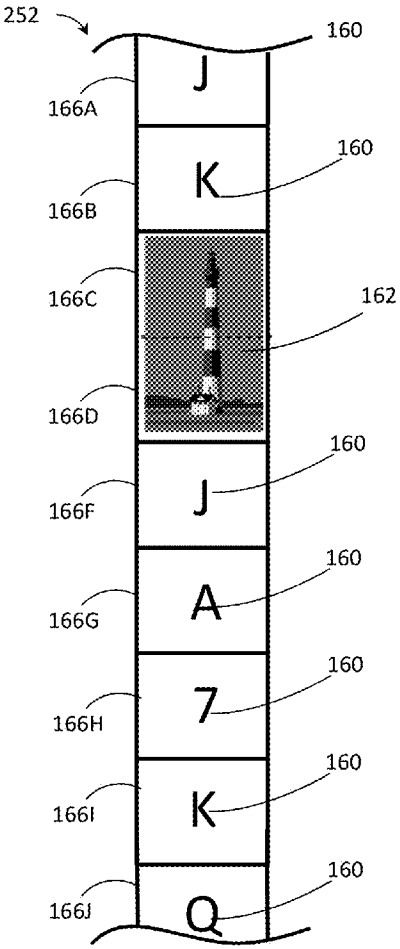
Figure 8A:
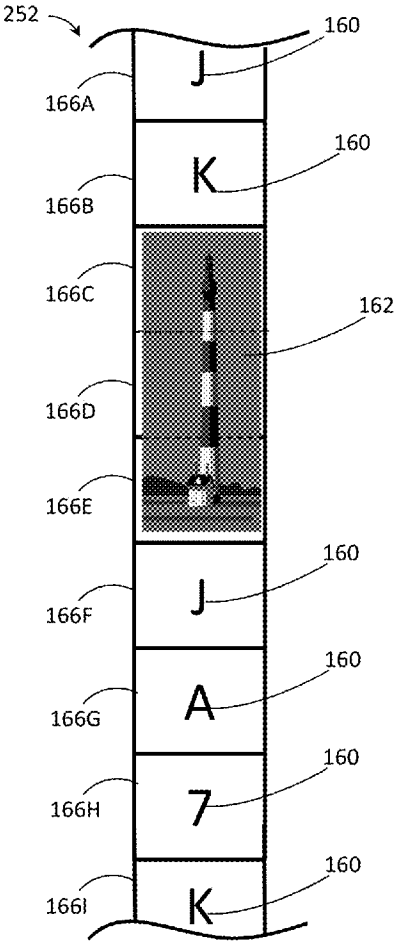

For example, FIG. 8A-8B illustrate an exemplary portion of a reel 252 (e.g., one of the reels 152A-152E) having a plurality of reel-symbol positions 166A-166J occupied by a plurality of symbols 160 and a one-by-three oversized symbol 162 (i.e., the oversized symbol 162 occupies three array positions 168 when the entire oversized symbol 162 is displayed in the array 164). FIG. 8A illustrates the reel 252 prior to the determination of the rest locations of the reel-symbol positions 166A-166J for a play of the wagering game (i.e., the image of the oversized symbol 162 has not been graphically reconfigured). FIG. 8B illustrates the reel 252 as it would be displayed during the spinning and after stopping if it was determined that only two of the reel-symbol positions 166C, 166D occupied by the oversized symbol 162 have rest locations in visual association with the array 164. Because the reel-symbol position 166E would not be displayed for the outcome of the play of the wagering game, the reel-symbol position 166E can be omitted (as shown in FIG. 8B) during the spinning and stopping to reduce confusion and avoid prematurely tipping off the player as to the composition of the outcome for the play of the wagering game.

According to alternative aspects of the present disclosure, instead of omitting the reel-symbol position(s) 166 determined to not be in visual association with the array 164, a substitute image can be displayed for the reel-symbol positions 166 of the oversized symbol 162 that are determined to not be in visual association with the array 164. For example, FIG. 8C illustrates the reel 252 after the graphical reconfiguration of oversized symbol 162 in FIG. 8A but with a substitute image 163 (i.e., the "BAR" image) displayed in the reel-symbol position 166E. It is contemplated that the substitute image 163 can be a fixed, predetermined image or a randomly determined image. According to further alternative aspects of the present disclosure, the image of the oversized symbol 162 can be displayed without a graphical reconfiguration during the spinning of the reels 152A-152E. Rather, the image of the oversized symbol 162 can be graphically reconfigured to the size determined at block 216 for the portion of the oversized symbol 162 displayed in the array 164 after the reels 152A-152E come to a stop.

According to some aspects, if it is determined that the entire oversized symbol 162 or no portion of the oversized symbol 162 will be displayed in the array 164 when the reels 152A-152E are stopped (i.e., based on the rest locations with respect to the array 164), the oversized symbol 162 can be displayed during the spinning of the reels 152A-152E without any graphical reconfiguration. That is, the image of the oversized symbol 162 can extend over all reel-symbol positions 166 occupied by the oversized symbol 162 during the spinning of the reel 152A-152E. For example, if it is determined that all or none of the reel-symbol positions 166C-166E for the reel 252 in FIG. 8A are to be displayed in the array 164, the reel 252 can be displayed with the image for the oversized symbol 162 extending over all of the reel-symbol positions 166C-166E during the spinning of the reels 152.

According to additional and/or alternative aspects, if it is determined that the entire oversized symbol 162 or no portion of the oversized symbol 162 will be displayed in the array 164 when the reels 152A-152E are stopped, the oversized symbol 162 can be displayed during the spinning of the reels 152A-152E with a size that is randomly determined. For example, if it was determined that all or none of the reel-symbol positions 166C-166E for the reel 252 in FIG. 8A was to be displayed in the array 164 (i.e., the rest locations are not be in visual association with the array 164 when the reel 252 is stopped), the entire image can randomly extend over one, two, or three of the reel-symbol positions 166C-166E during the spinning of the reel 252.

In the examples illustrated and described above with respect to FIGS. 4-8C, the oversized symbol 162 is graphically reconfigured when the oversized symbol 162 is only partially displayed within the array 164 due to at least one reel-symbol position 166 occupied by the oversized symbol 162 not being in visual association with the array positions 168. According to additional and/or alternative aspects of the present disclosure, the oversized symbol 162 can be graphically reconfigured (as described above) when the oversized symbol 162 is partially displayed within the array 164 due to at least one reel-symbol position 166 occupied by the oversized symbol 162 being overlapped by another symbol in the array 164. That is, the graphical reconfiguration can be provided when although all reel-symbol positions 166 occupied by the oversized symbol 162 are in visual association with the array 164, a portion of the oversized symbol 162 is not displayed because it is overlapped by another symbol in the array 164.

According to aspects of the present disclosure, a portion of the oversized symbol 162 can be overlapped by a mega symbol 170. A mega symbol 170 is a symbol that is configured to occupy at least two array positions 168 on each of at least two adjacent columns of the array 164 when the mega symbol 170 is entirely displayed in the array 164. In other words, a mega symbol 170 has a minimum size of two-by-two array positions 168 when entirely displayed in the array 164.

Figure 9:
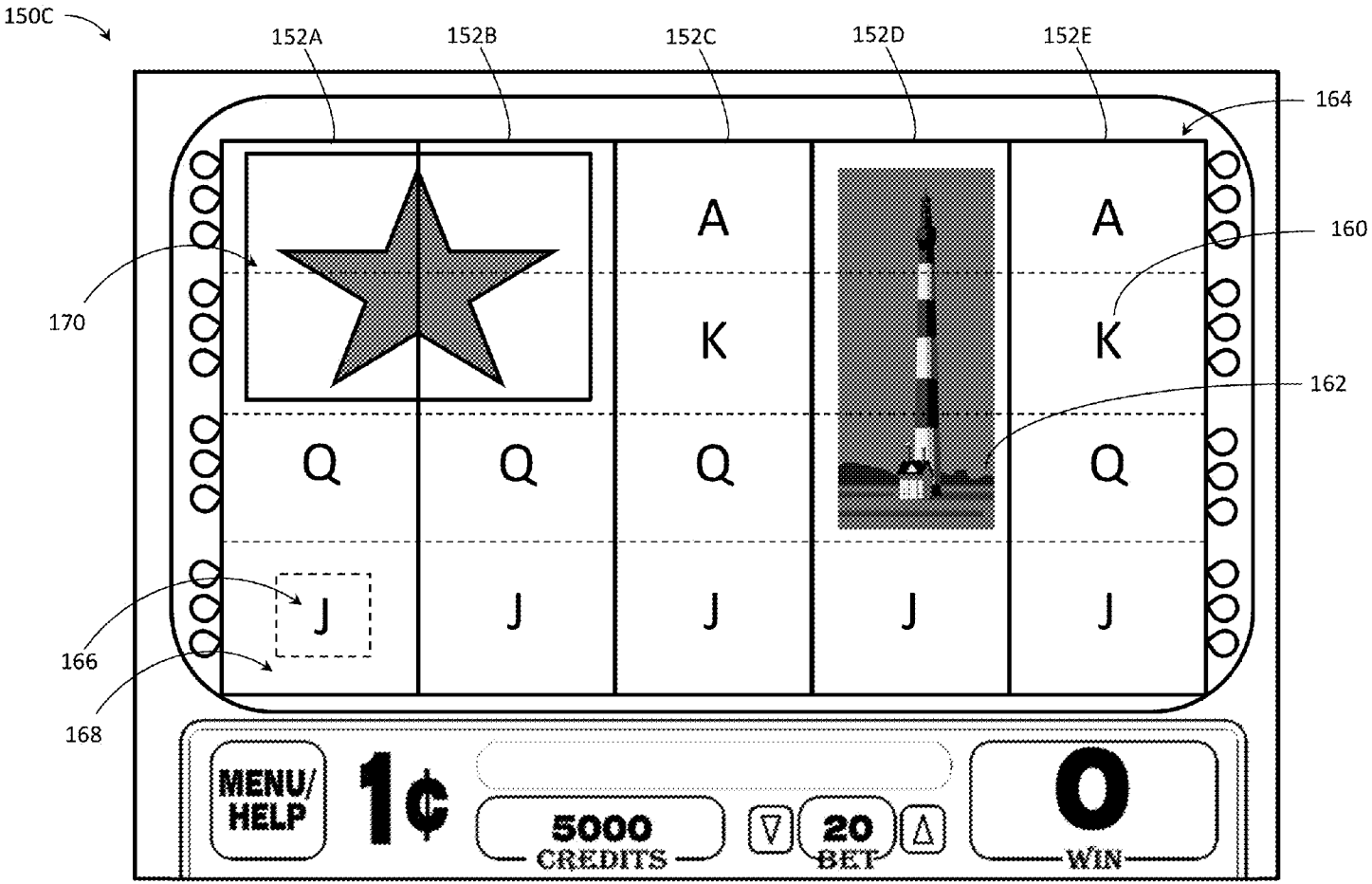
FIG. 9 is an image of an exemplary game screen of a wagering game displayed on a gaming terminal, according to an embodiment of the present invention.
Figure 10:
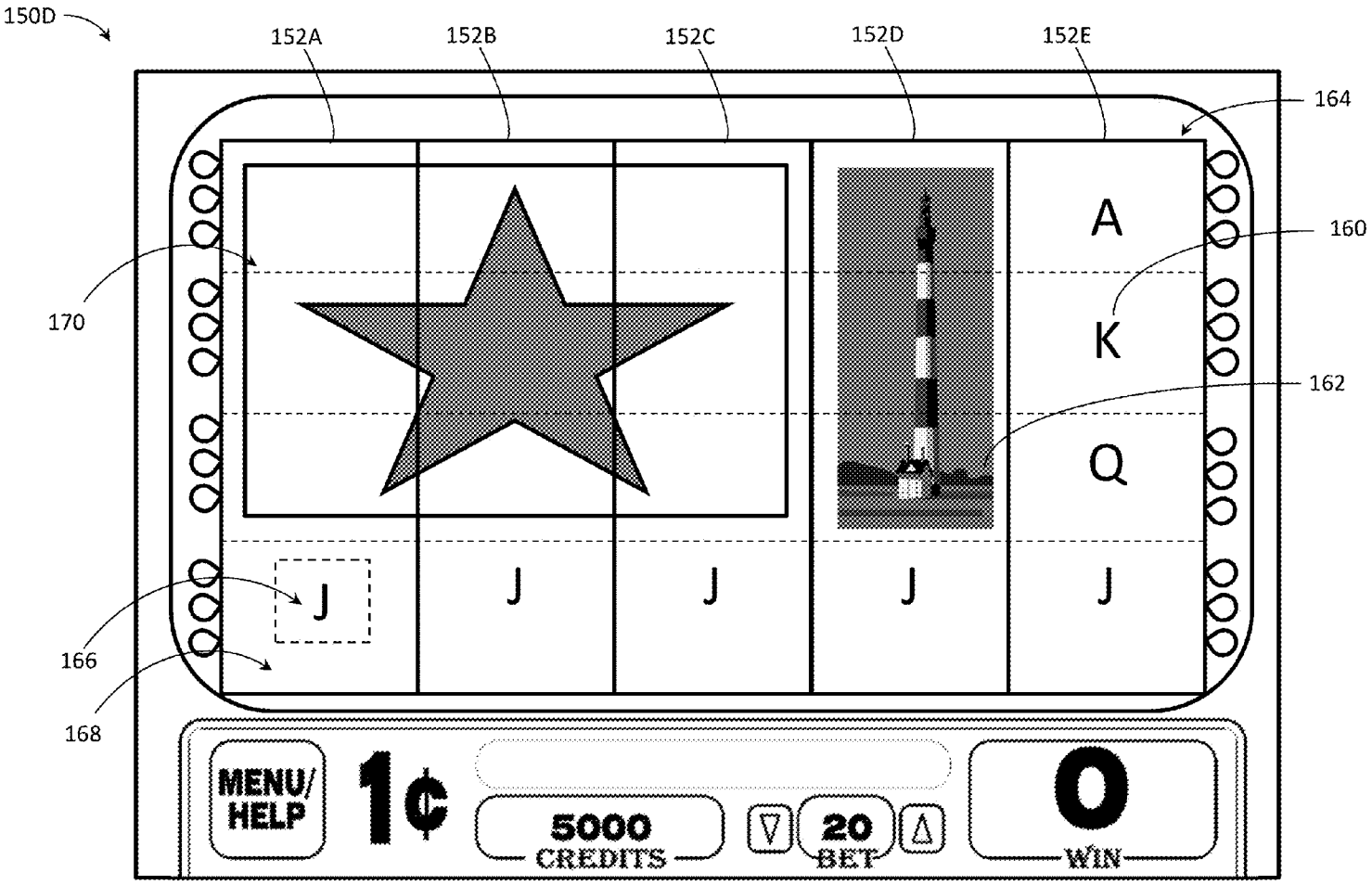
FIG. 10 is an image of an exemplary game screen of a wagering game displayed on a gaming terminal, according to an embodiment of the present invention.

FIGS. 9-14B illustrate images of exemplary game screens 150C-150G including a mega symbol 170, a plurality of symbols 160, and an oversized symbol 162. In FIG. 9, a two-by-two mega symbol 170 is displayed in the array 164 across the first reel 152A and the second reel 152B. In FIG. 10, a three-by-three mega symbol 170 is displayed in the array 164 across the first reel 152A, the second reel 152B, and the third reel 152C. It should be understood that the mega symbol 170 can have other sizes (i.e., a size ranging from two-by-two positions 168 to the size of the entire array 164) and/or other positions within the array 164 than those illustrated in FIGS. 9-10. Additionally, although the examples illustrated and described herein generally include square shaped mega symbols 170, it should be understood that the mega symbols 170 can have other shapes so long as the mega symbol 170 is configured to occupy at least two array positions 168 on each at least two adjacent columns of the array 164 when the mega symbol 170 is entirely displayed in the array 164. The mega symbols 170 may take on other forms both symmetrical and asymmetrical as well, such as a two by four sized mega symbol 170, a mega symbol 170 stretching three array columns and having a height of two in the first column, three in the second column, and two in the third column, etc.

During a play of the wagering game, the reels 152A-152E are spun, moving the symbols 160, the oversized symbol(s) 162, and the mega symbol(s) 170 through the array 164 before stopping at the determined rest locations. According to some aspects of the present disclosure, the mega symbol 170 can be indexed to one of the symbol-bearing reels 152A-152E such that a single symbol-bearing reel 152A-152E moves the mega symbol 170 through the array 164. The portion of the mega symbol 170 that is not indexed to a reel 152A-152E overlaps with (or extends over) the symbols 160 or the oversized symbol 162 on the adjacent reel(s) 152A-152E. That is, the mega symbol 170 can occupy symbol positions on one reel 152A-152E but occupy array positions 168 in multiple columns of the array 164 by overlapping with the symbols 160 of the adjacent reels 152A-152E when the mega symbol 170 is displayed within the array 164.

Figure 11:
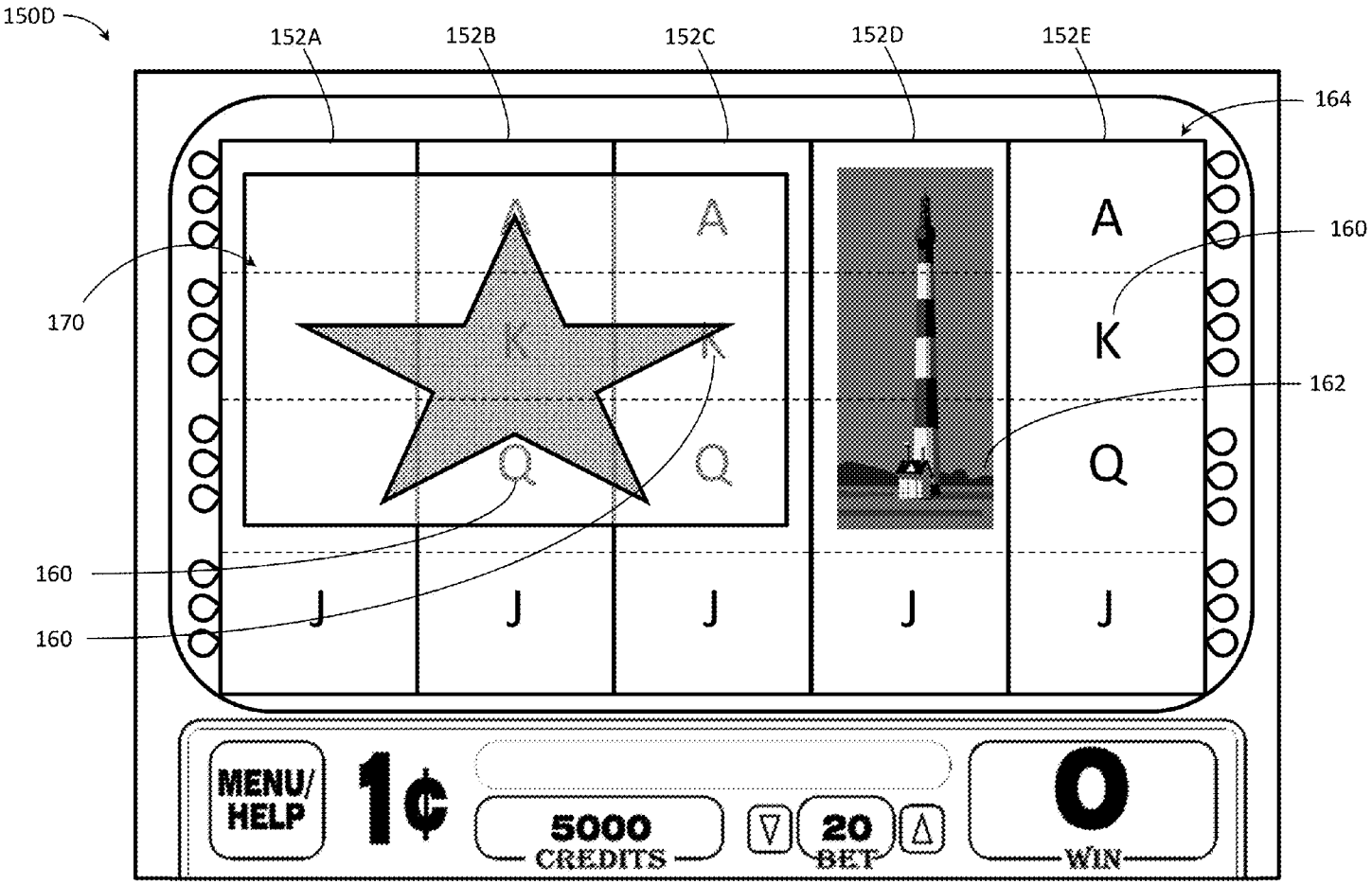
FIG. 11 is an image of an exemplary game screen of a wagering game displayed on a gaming terminal, according to an embodiment of the present invention.

FIG. 11 shows one exemplary implementation for the outcome shown in FIG. 10 with the mega symbol 170 illustratively modified (for explanation purposes) so as to show the overlapped symbols 160 beneath the mega symbol 170; however, it should be understood that the mega symbol 170 is displayed to the player as shown in FIG. 10. As shown in FIG. 11, the mega symbol 170 is indexed to three reel-symbol positions 166 on the first reel 152A and extends over three reel-symbol positions 166 on the adjacent reels 152B, 152C. Because the mega symbol 170 overlaps with the adjacent reels 152B-152C, some array positions 168 are occupied by both the mega symbol 170 and the symbols 160 of the adjacent reels 152B-152C when the mega symbol 170 is in visual association with the array 164.

Although the mega symbol 170 and the symbols 160 overlapped by the mega symbol 170 co-occupy array positions 168, only the mega symbol 170 is displayed in the overlapping portion of the array 164 (as shown in FIG. 10). In general the reel 152A-152E to which the mega symbol 170 is index can be referred to as a superclump reel (e.g., the first reel 152A in FIG. 11), which is associated with a different layer than the adjacent reels (e.g., the second reel 152B and the third reel 152C in FIG. 11). The mega symbol 170 can sit at a higher layer than the adjacent reels so that the mega symbol 170 is displayed and evaluated but the symbols 160 (and/or the oversized symbol 162) overlapped by the mega symbol 170 are not displayed and evaluated. It is contemplated that, according to some aspects, when multiple mega symbols 170 are employed, the mega symbols 170 can sit at a variety of different layers according to a hierarchy based on the type of mega symbol 170 and/or the reel (e.g., the reels 152A-152E) to which the mega symbols 170 are indexed. While the mega symbol 170 shown in FIG. 11 is indexed to the first reel 152A and extends rightward over the adjacent reels 152B-152C, it should be understood that the mega symbol 170 can alternatively be indexed to any one of the reels 152A-152E and extend in a rightward direction, a leftward direction, or both directions over adjacent reels 152A-152E.

When the mega symbol 170 is indexed to a single reel 152A-152E, the rest location of the mega symbol 170, the symbols 160, and the oversized symbol 162 can be determined by one determination for each of the reels 152A-152E. For example, in FIG. 11, the mega symbol 170 is indexed to the first reel 152A and extends over the second reel 152B and the third reel 152C. The rest locations of the mega symbol 170 and the symbols 160 of the reels 152A, 152B, 152C with respect to the array 164 are determined by three determinations (i.e., one determination for the reel 152A to which the mega symbol 170 is indexed and one determination for each reel 152B, 152C over which the mega symbol 170 extends). The positions of the symbols 160 and the oversized symbol 162 on the remaining reels 152D, 152E can each be separately determined such that the rest location of all symbols 160, oversized symbols 162, and mega symbols 170 displayed within the array 164 requires a total of five determinations (i.e., one determination for each reel 152A-152E).

Figure 12:
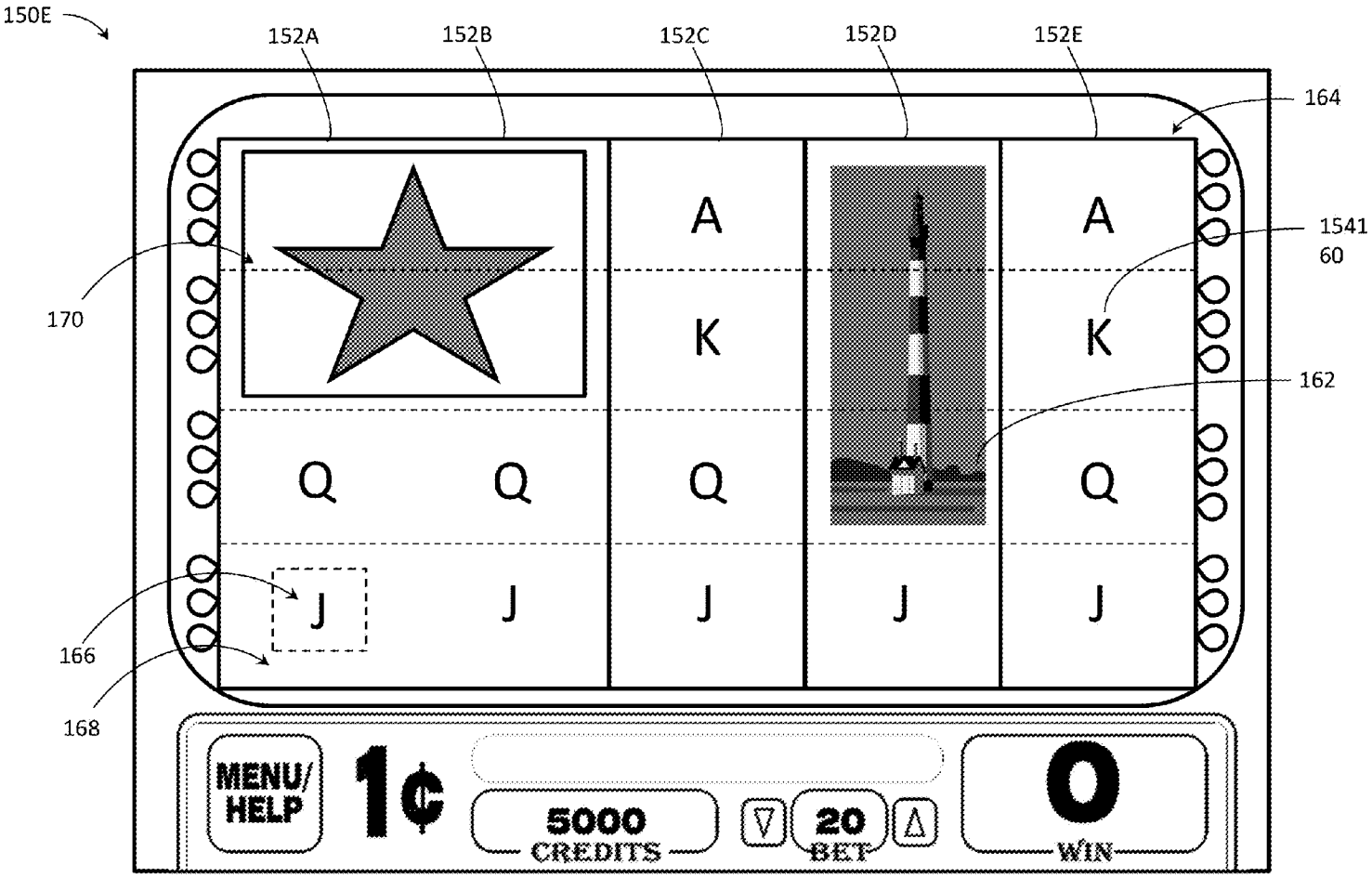
FIG. 12 is an image of an exemplary game screen of a wagering game displayed on a gaming terminal, according to an embodiment of the present invention.
Figure 13:
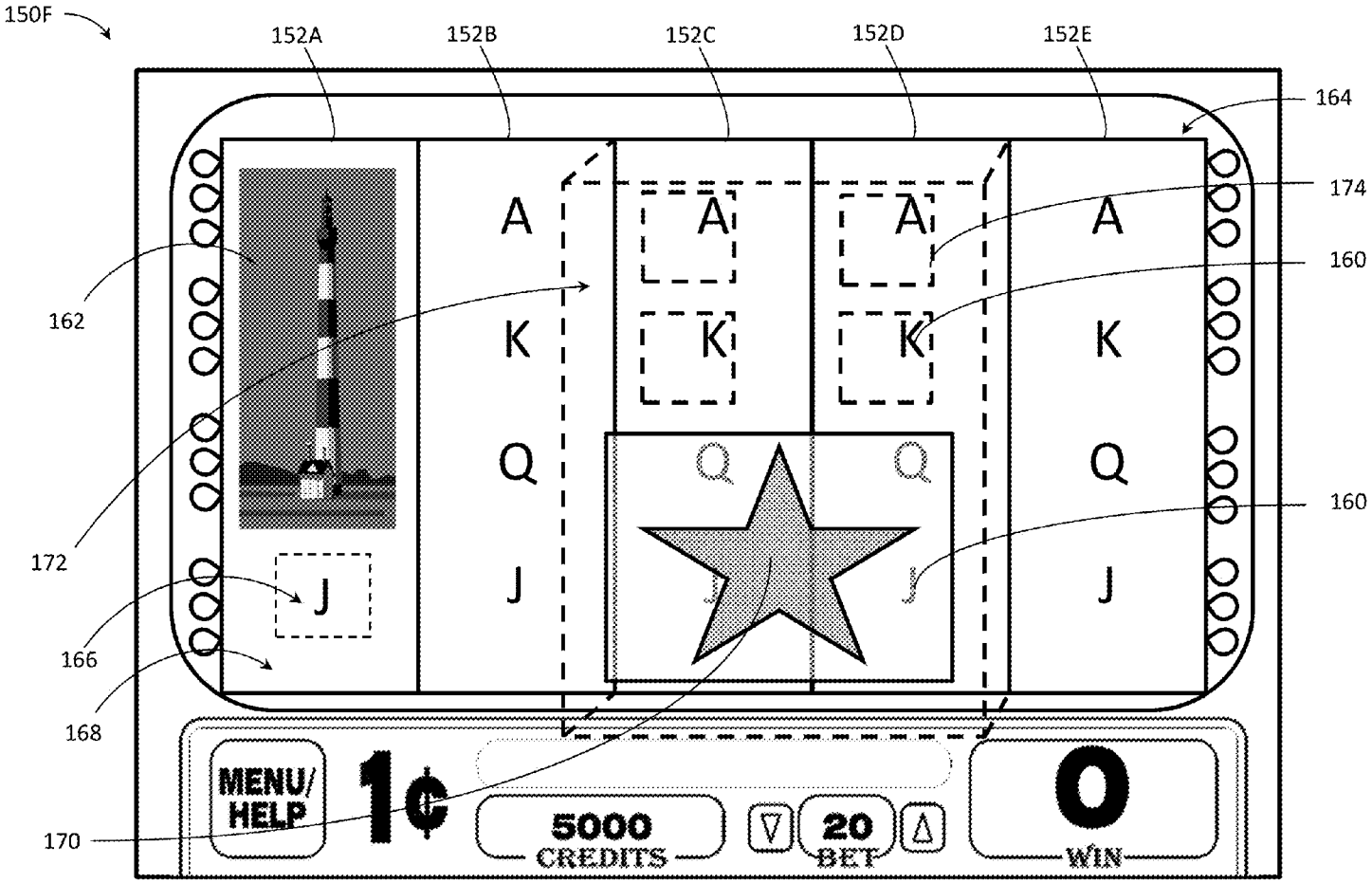
FIG. 13 is an image of an exemplary game screen of a wagering game displayed on a gaming terminal, according to an embodiment of the present invention.

With the mega symbol 170 indexed to a single reel 152A-152E, the spinning and stopping of the reels 152A-152E can be visually portrayed such that the reel 152A-152E on which the mega symbol 170 is indexed and the adjacent reels 152A-152E overlapping with the mega symbol 170 appear to spin and stop in synchronization (e.g., in FIG. 12, the mega symbol 170 can be indexed to the second reel 152B, overlap the first reel 152A, and the reels 152A, 152B appear to be combined or otherwise spin and stop in synchronization). Alternatively, the reel 152A-152E on which the mega symbol 170 is indexed can spin and stop separately from the adjacent reels 152A-152E over which the mega symbol 170 extends (e.g., in FIG. 10, the first reel 152A and the mega symbol 170 indexed thereto can stop while the second reel 152B and the third reel 152C continue to spin).

According to additional and/or alternative aspects of the present disclosure, the mega symbol 170 can be indexed to none of the symbol-bearing reels 152A-152E. Instead, as shown for example in FIG. 13, the mega symbol 170 can be indexed to a special reel 172 overlapping with (or extending over) the symbol-bearing reels 152A-152E. The special reel 172 consists of blanks 174 and the mega symbol 170. The blanks 174, in some embodiments, allow this layer to be transparent such that any mega symbol 170 that appears on the special reel 172 is the only portion of the special reels 152 that is visible to the player. The rest position of the mega symbol 170 is determined independently from the symbols 160 and the oversized symbol 162 on the reels 152A-152E. Accordingly, the rest location of the symbols 160, the oversized symbol 162, and the mega symbol 170 with respect to the array 164 can be determined by six determinations if a single special reel 172 is used (i.e., one determination for each reel 152A-152E and one determination for the special reel 172). Alternatively, multiple special reels 172 could be utilized to provide mega symbols 170 for the wagering game and the determination of the rest location for these special reels 172 could be made by drawing a single random number or by drawing a separate random number for each special reel 172.

While the mega symbol 170 and the symbols 160 overlapped by the mega symbol 170 co-occupy array positions 168, only the mega symbol 170 is displayed in the overlapping portion of the array 164 as described above. With the mega symbol 170 indexed to a special reel 172, the spinning and stopping of the reels 152A-152E can be visually portrayed such that the special reel 172 and the reels 152A-152E that overlap with the special reel 172 appear to spin and stop in synchronization (e.g., in FIG. 13, the reels 152C, 152D and the special reel 172 can appear to be combined or to otherwise spin and stop in synchronization). Alternatively, the special reel 172 can spin and stop separately from the reels 152A-152E (e.g., in FIG. 13, the reels 152C and 152D can individually and separately stop while the special reel 172 continues to spin or vice versa).

Additional details for a symbol such as the mega symbol 170 overlapping over one or more reels 152A-152E is disclosed in U.S. patent application Ser. No. 13/783,273, titled "Wagering Game With Reel Array Having Extended Symbol Visually Overlaying Adjacent Reel" and filed on Mar. 2, 2013, and U.S. patent application Ser. No. 13/835,026, titled "Wagering Games Employing A Mega Symbol" and filed on Mar. 15, 2013, which are herein incorporated by reference in their entirety.

Figure 14B:
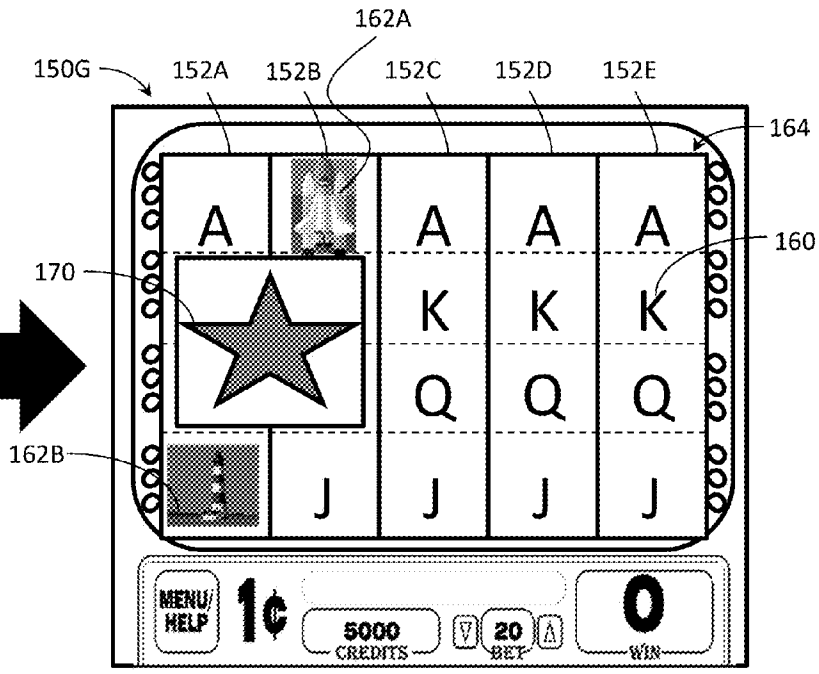
FIGS. 14A-14B are images of an exemplary game screen of a wagering game displayed on a gaming terminal, according to an embodiment of the present invention.
Figure 14A:
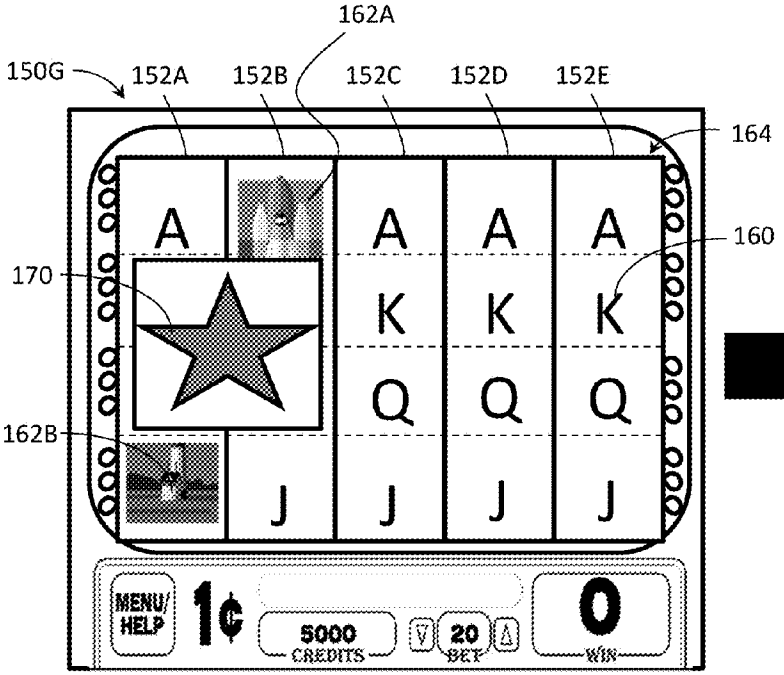

Referring now to FIGS. 14A-14B, an example of a graphical reconfiguration of an oversized symbol 162 is illustrated for an outcome of a wagering game in which a portion of the oversized symbol 162 is partially displayed within the array 164 due to at least one reel-symbol position 166 occupied by the oversized symbol 162 being overlapped by a mega symbol 170.

FIGS. 14A-14B illustrate an exemplary outcome 150G of a play of a wagering game including a plurality of symbols 160, a first oversized symbol 162A, a second oversized symbol 162B, and a mega symbol 170 in visual association with the array 164. The first oversized symbol 162A occupies two reel-symbol positions 166 on the second reel 152B such that when the entire first oversized symbol 162A is displayed in the array 164, the first oversized symbol 162A occupies two array positions 168. The second oversized symbol 162B occupies three reel-symbol positions 166 on the first reel 152A such that when the entire second oversized symbol 162B is displayed in the array 164, the second oversized symbol 162B occupies three array positions 168. In both FIG. 14A and FIG. 14B, a portion of the first oversized symbol 162A and a portion of the second oversized symbol 162B are overlapped by the mega symbol 170. FIG. 14A illustrates the outcome as it would be displayed without a graphical reconfiguration of the first oversized symbol 162A and the second oversized symbol 162B. As shown in FIG. 14A, the first oversized symbol 162A and the second oversized symbol 162B appear cutoff, incomplete, and confusing to the player. By contrast, FIG. 14B illustrates the outcome of FIG. 14A after a graphical reconfiguration of the first oversized symbol 162A and the second oversized symbol 162B. As shown in FIG. 14B, the entire image associated with the first oversized symbol 162A and the entire image associated with the second oversized symbol 162B are displayed, allowing the player to clearly and fully understand exactly what symbol occupies the array positions 168 occupied by the non-overlapped portions of the oversized symbols 162A, 162B.

The process 200 illustrated and described above with respect to FIG. 7 can also be employed for graphically reconfiguring the image of the oversized symbol 162 when a portion of the oversized symbol 162 is partially displayed within the array 164 due to at least one reel-symbol position 166 occupied by the oversized symbol 162 being overlapped by another symbol (e.g., a mega symbol 170) in the array 164. For example, at block 214, it can be determined whether only a portion of the oversized symbol 162 will be displayed within the array 164 based on the rest location of the oversized symbol 162 and the rest location of the overlapping symbol (e.g., a mega symbol 170) determined at block 212. If the rest locations of the overlapping symbol and the oversized symbol 162 are such that the overlapping symbol will extend over one or more array positions 168 occupied by the oversized symbol 162, the image of the oversized symbol 162 is graphically reconfigured such that the entire image extends over the array positions 168 occupied by the oversized symbol 162 that are not overlapped at block 218.

In the example embodiments described above with respect to FIGS. 4-14B, the oversized symbol 162 is graphically reconfigured such that the entire image for the oversized symbol 162 extends over the array positions 168 occupied by the partially displayed portion of the oversized symbol 162. According to additional and/or alternative aspects, the oversized symbol 162 can be graphically reconfigured such that a different portion of the image extends over the array positions 168 for the partially displayed portion of the oversized symbol 162 within the array 164. In particular, the portion of the image can be changed such that at least a predetermined subset of the image is displayed. The predetermined subset can be a more recognizable portion of the image than the portion of the image that would otherwise be displayed if the oversized symbol 162 was not graphically reconfigured.

Figure 15B:
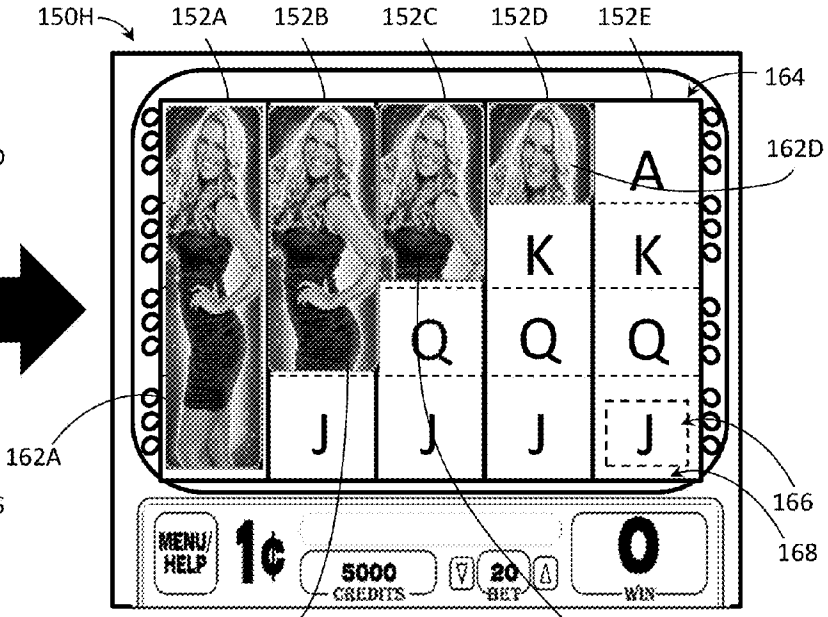
FIGS. 15A-15B are images of an exemplary game screen of a wagering game displayed on a gaming terminal, according to an embodiment of the present invention.
Figure 15A:
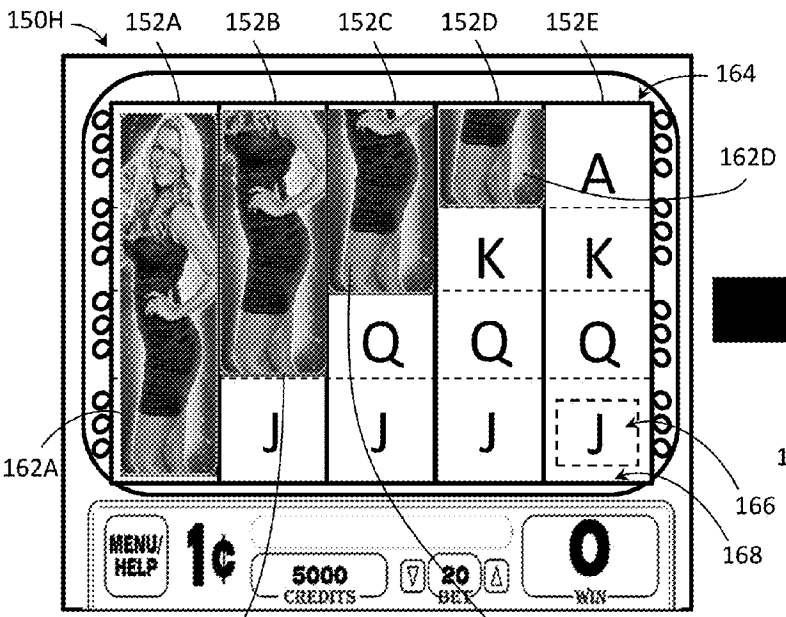

FIGS. 15A-15B illustrate one non-limiting example in which an oversized symbol 162A-162D is graphically reconfigured to change the portion of the image of the oversized symbol 162A-162D that extends over the array positions 168 occupied by the oversized symbol 162A-162D. In the example game screen 150H illustrated in FIGS. 15A-15B, an oversized symbol 162A-162D is fully displayed on the first reel 152A and partially displayed on each of the second reel 152B, the third reel 152C, and the fourth reel 152D. In particular, FIG. 15A illustrates a first oversized symbol 162A on the first reel 152A that is fully displayed in four array positions 168, a second oversized symbol 162B on the second reel 152B that is partially displayed in three array positions 168, a third oversized symbol 162C on the third reel 152C that is partially displayed in two array positions 168, and a fourth oversized symbol 162D that is partially displayed in one array position 168.

FIG. 15B illustrates the game screen 150H after the process 200 described and illustrated for FIG. 7 has been conducted for the outcome illustrated in FIG. 15A (i.e., after the images for the oversized symbols 162A-D have been graphically reconfigured or not based on the rest location of the oversized symbols 162A-D). The first oversized symbol 162A is fully displayed in the array 164 in FIG. 15A and, thus, no graphical reconfiguration is employed for the image of the first oversized symbol 162A in FIG. 15B. The remaining oversized symbols 162B-D are partially displayed in the array 164 in FIG. 15A and, thus, the image associated with the oversized symbols 162B-D is graphically reconfigured in FIG. 15B. In particular, the image of the oversized symbols 162B-D is graphically reconfigured such that at least the portion of the image associated with the topmost symbol position of the oversized symbol 162A-D (i.e., at least the woman's face) extends over the array positions 168 occupied by the oversized symbols 162B-D. That is, the portion of the image associated with the topmost symbol position of the oversized symbol 162A-162D is the predetermined subset of the image that is displayed as a result of the graphical reconfiguration. As demonstrated by this example, graphically reconfiguring the image of the special symbol such that at least a predetermined subset of the image extends over the array positions 168 occupied by the oversized symbol 162 can provide a more recognizable indication of the oversized symbol 162 to the player.

It should be understood that, according to additional and/or alternative aspects of the present disclosure, the predetermined portion of the image for the oversized symbol 162 can include a top portion, a bottom portion, a middle portion, or any combination thereof so as to display a more recognizable subset of the image to the player. Additionally, it should be understood that the graphically reconfigured image can be displayed during and/or after the spinning of the reels 152A-152E as described above. Indeed, the process 200 illustrated and described above with respect to FIG. 7 can also be employed for graphically reconfiguration described and illustrated with respect to FIGS. 15A-15B.

It should further be understood that the graphical reconfiguration can include a combination of the concepts described and illustrated for FIGS. 4-15B. Accordingly, the graphical reconfiguration described and illustrated herein can more generally be considered as graphically reconfiguring the image of the oversized symbol such that at least one of a different size of the image and/or a different portion of the image extends over the array positions occupied by the partially displayed oversized symbol.

FIG. 7, described by way of example above, represents one algorithm that corresponds to at least some instructions executed by the CPU 30 in FIG. 2 to perform the above described functions associated with the described concepts. It is also within the scope and spirit of the present concepts to omit steps, include additional steps, and/or modify the order of steps presented above.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects. In particular, it should be understood that an image of an oversized symbol 162 can be graphically reconfigured based on the rest location of the oversized symbol 162 with respect to both the array 164 and the rest location of another overlapping symbol (e.g., a mega symbol 170). For example, if an oversized symbol 162 was determined to be only partially displayed due to the oversized symbol 162 being partially located outside of the array 164 and partially overlapped by a mega symbol 170 within the array 164, the image of the oversized symbol 162 can be graphically reconfigured to extend over the reel-symbol position(s) 166 occupied by the oversized symbol 162 that are in association with an array position 168 and not overlapped by the mega symbol 170.

What is claimed is:

1. A gaming system comprising:

one or more input devices;

one or more display devices;

one or more game processors;

one or more memory devices storing instructions that, when executed by the one or more game processors, cause the gaming system to:

detect, via at least one of the one or more input devices, a physical item associated with monetary value that establishes a credit balance on a credit meter displayed on one of the one or more display device;

receive, via at least one of the one or more input devices, an input indicative of a wager drawn on the credit balance;

initiate a wagering game responsive to the input;

display, on the at least one display device an array having a plurality of array positions, each of the plurality of array positions being populated by at least one of a plurality of symbols located on a plurality of symbol-bearing reels, the plurality of symbols including an oversized symbol, the oversized symbol occupying a plurality of reel-symbol positions on a first one of the plurality of symbol-bearing reels, the oversized symbol having an image extending over the plurality of reel-symbol positions occupied by the oversized symbol;

determine a rest location of the plurality of symbols for a play of a wagering game;

determine whether the oversized symbol will be only partially displayed in the array based on the rest location of the oversized symbol, the plurality of reel-symbol positions occupied by the oversized symbol including a first portion that will be displayed in the array and a second portion that will not be displayed in the array;

in response to the determination that the oversized symbol will be only partially displayed in the array, graphically reconfigure the image of the oversized symbol such that at least one of a different size of the image or a different portion of the image extends over the first portion of the plurality of reel-symbol positions occupied by the oversized symbol;

spin and stop the plurality of symbol-bearing reels to place the plurality of symbols on the symbol-bearing reels in the determined rest locations with respect to the array, the first portion of the oversized symbol being displayed in the array with the graphically reconfigured image; and award a payout based on the symbols displayed in the array.

2. The gaming system of claim 1, wherein the oversized symbol will be only partially displayed in the array when the first portion of the plurality of reel-symbol positions occupied by the oversized symbol is in visual association with respective ones of the plurality of array positions and the second portion of the plurality of reel-symbol positions occupied by the oversized symbol is not in visual association with any of the plurality of array positions.

3. The gaming system of claim 1, wherein the plurality of symbols further includes a mega symbol configured to occupy at least two array positions on each of at least two adjacent columns of the array, the oversized symbol being only partially displayed in the array when the mega symbol overlaps at least one reel-symbol position occupied by a portion of the oversized symbol that is in visual association with the array such that the portion of the oversized symbol overlapped by the mega symbol is not displayed in the array.

4. The gaming system of claim 3, wherein the mega symbol is indexed to a second one of the plurality of symbol-bearing reels and extends over the first one of the plurality of symbol-bearing reels.

5. The gaming system of claim 1 wherein the image is graphically reconfigured after the spin and stop placed the plurality of symbols in the determined rest locations with respect to the array.

6. The gaming system of claim 1, wherein the second portion of the plurality of reel-symbol positions is omitted during the spin and stop of the plurality of symbol-bearing reels.

7. The gaming system of claim 1, wherein the instructions further cause the gaming system to display a substitute image for the second portion of the plurality of reel-symbol positions occupied by the oversized symbol during the spin and stop of the plurality of symbol-bearing reels.

8. A computer-implemented method in a gaming system, the gaming system including one or more game processors, an electronic display device, and an electronic input device configured to detect a physical item associated with monetary value that establishes a credit balance on a credit meter displayed on the electronic display device, the method comprising:

receiving, via the electronic input device, an input indicative of a wager drawn on the credit balance;

initiating, via the one or more game processors, a wagering game responsive to the input;

displaying on at least one display device an array having a plurality of array positions, each of the plurality of array positions being populated by at least one of a plurality of symbols located on a plurality symbol-bearing reels, the plurality of symbols including an oversized symbol, the oversized symbol occupying a plurality of reel-symbol positions on a first one of the plurality of symbol-bearing reels, the oversized symbol having an image extending over the plurality of reel-symbol positions occupied by the oversized symbol;

determining a rest location of the plurality of symbols for a play of a wagering game;

determining whether the oversized symbol will be only partially displayed in the array based on the rest location of the oversized symbol, the plurality of reel-symbol positions occupied by the oversized symbol including a first portion that will be displayed in the array and a second portion that will not be displayed in the array;

m response to the determination that the oversized symbol will be only partially displayed in the array, graphically reconfiguring the image of the oversized symbol such that at least one of a different size of the image or a different portion of the image extends over the first portion of the plurality of reel-symbol positions occupied by the oversized symbol;

spinning and stopping the plurality of symbol-bearing reels to place the plurality of symbols on the symbol-bearing reels in the determined rest locations with respect to the array, the first portion of the oversized symbol being displayed in the array with the graphically reconfigured image; and awarding a payout based on the symbols displayed in the array.

9. The computer-implemented method of claim 8, wherein the graphical reconfiguring includes selecting a size from a plurality of potential sizes for the image associated with the oversized symbol based on the rest location of the oversized symbol.

10. The computer-implemented method of claim 8, wherein the oversized symbol will be only partially displayed in the array when the first portion of the plurality of reel-symbol positions occupied by the oversized symbol is in visual association with respective ones of the plurality of array positions and the second portion of the plurality of reel-symbol positions occupied by the oversized symbol is not in visual association with any of the plurality of array positions.

11. The computer-implemented method of claim 8, wherein the plurality of symbols further includes a mega symbol configured to occupy at least two array positions on each of at least two adjacent columns of the array, the oversized symbol being only partially displayed in the array when the mega symbol overlaps at least one reel-symbol position occupied by a portion of the oversized symbol that is in visual association with the array such that the portion of the oversized symbol overlapped by the mega symbol is not displayed in the array.

12. The computer-implemented method of claim 11, the graphically reconfiguring occurs after the spinning and stopping is complete.

13. The computer-implemented method of claim 11, wherein the mega symbol is indexed to a special reel overlaying at least two of the symbol-bearing reels including the first one of the plurality of symbol-bearing reels.

14. The computer-implemented method of claim 8, wherein the second portion of the plurality of reel-symbol positions are omitted during the spinning and stopping of the plurality of symbol-bearing reels.

15. The computer-implemented method of claim 8, wherein the instructions further cause the gaming system to display a substitute image for the second portion of the plurality of reel symbol positions occupied by the oversized symbol during the spinning and stopping of the plurality of symbol-bearing reels.

16. One or more physical machine-readable storage media including instructions which, when executed by one or more game processors, cause the one or more game processors to perform operations comprising:

detecting, via at least one of the one or more input devices, a physical item associated with monetary value that establishes a credit balance on a credit meter displayed on one of the one or more display device;

receiving, via one or more input devices, an input indicative of a wager drawn from the credit balance;

displaying on at least one display device an array having a plurality of array positions, each of the plurality of array positions being populated by at least one of a plurality of symbols located on a plurality symbol-bearing reels, the plurality of symbols including an oversized symbol, the oversized symbol occupying a plurality of reel-symbol positions on a first one of the plurality of symbol-bearing reels, the oversized symbol having an image extending over the plurality of reel-symbol positions occupied by the oversized symbol;

determining a rest location of each of the plurality of symbols with respect to the array;

determining whether the rest location of the oversized symbol is indicative of only a portion of the plurality of reel-symbol positions occupied by the oversized symbol being displayed in the array;

in response to the rest location of the oversized symbol being indicative of only the portion of the plurality of reel-symbol positions occupied by the oversized symbol being displayed in the array, graphically reconfiguring the image associated with the oversized symbol such that at least one of a different size of the image or a different portion of the image extends over the portion of the plurality of reel-symbol positions;

spinning and stopping the plurality of symbol-bearing reels to place the plurality of symbols on the symbol-bearing reels in the determined rest locations with respect to the array, the first portion of the oversized symbol being displayed in the array with the graphically reconfigured image; and awarding a payout based on the plurality of symbols displayed in the array.

17. The one or more physical machine-readable storage media of claim 16, wherein the rest location of the oversized symbol is indicative of only the portion of the plurality of reel-symbol positions being displayed in the array when some but not all of the plurality of reel-symbol positions occupied by the oversized symbol are in visual association with respective ones of the plurality of array positions and others of the plurality of reel-symbol positions occupied by the oversized symbol are not in visual association with any of the plurality of array positions.

18. The one or more physical machine-readable storage media of claim 16, wherein the plurality of symbols further includes a mega symbol configured to occupy at least two array positions on each of at least two adjacent columns of the array, the rest location of the oversized symbol being indicative of only the portion of the plurality of reel-symbol positions being displayed in the array when the mega symbol overlaps at least one but not all reel-symbol positions occupied by the oversized symbol that are in visual association with the array.

19. The one or more physical machine-readable storage media of claim 18, wherein the image is graphically reconfigured after the spin and stop.

20. The one or more physical machine-readable storage media of claim 18, wherein the image is graphically reconfigured prior to the spin and stop.

* * * * *